US006582866B2

(12) United States Patent
Kumar et al.

(10) Patent No.: US 6,582,866 B2
(45) Date of Patent: Jun. 24, 2003

(54) TONER WITH INCREASED SURFACE ADDITIVE ADHESION AND OPTIMIZED COHESION BETWEEN PARTICLES

(75) Inventors: Samir Kumar, Penfield, NY (US); Juan A. Morales-Tirado, Rochester, NY (US); D. Paul Casalmir, Sodus, NY (US); Scott M. Silence, Fairport, NY (US); Ying S. Molisani, Sherwood, OR (US); James M. Proper, Webster, NY (US); Paul L. Jacobs, Webster, NY (US); Geraldine Baer, Davis, CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/943,958

(22) Filed: Aug. 31, 2001

(65) Prior Publication Data

US 2003/0064310 A1 Apr. 3, 2003

(51) Int. Cl.[7] ..... G03G 9/10
(52) U.S. Cl. ..... 430/108.1; 430/110.1; 430/110.4
(58) Field of Search ..... 430/108.1, 110.1, 430/110.4

(56) References Cited

U.S. PATENT DOCUMENTS

| | | | | |
|---|---|---|---|---|
| 5,290,654 A | | 3/1994 | Sacripante et al. | 430/137 |
| 5,977,210 A | | 11/1999 | Patel et al. | 523/161 |
| 6,245,474 B1 | * | 6/2001 | Hsu et al. | 430/110.4 |

OTHER PUBLICATIONS

Blending Tool with an Enlarged Collision Surface for Increased Blend Intensity and Method of Blending Toners, filed Dec. 27, 2000, USSN 09/748,920 (D/A0433), James M. Proper.

Blending Tool with an Adjustable Collision Profile and Method of Adjusting the Collision Profile, filed Dec. 27, 2000, USSN 09/749,059 (D/A0433Q), James M. Proper.

An Improved Toner with Increased Amount of Surface Additives and Increased Surface Additive Adhesion, filed Dec. 21, 2001, USSN 10/024,196 (D/A0433Q1), James M. Proper.

* cited by examiner

*Primary Examiner*—Mark A. Chapman
(74) *Attorney, Agent, or Firm*—Richard F Spooner

(57) ABSTRACT

The present invention relates to a toner and process for making the improved toner. The improved toner comprises a toner resin comprising: at least one colorant; (b) at least one toner resin mixed with the colorant and formed into combined colorant and resin particles having an average size less than 15 microns; and (c) surface additive particles wherein the surface additives are adhered to the colorant and toner resin by an impaction process in a quantity greater than three (3) percent of the combined weight of resin and colorant in the toner. The invention also relates to an improved process for making toners, comprising: (a) forming toner particles averaging 4 to 10 microns in size and comprised of at least one toner resin and at least one colorant; and (b) blending sufficient surface additive particles and the toner particles in a high intensity blender for less than 10 minutes such that the weight of surface additives that become attached to toner particles is greater than three (3) percent of the weight of the classified particles

14 Claims, 11 Drawing Sheets

| | $H_{TOOL}$ mm | $W_{TOOL}$ mm | α DEGREES | $D_{TOOL}$ mm | $g_{GAP}$ mm |
|---|---|---|---|---|---|
| TOOL 50 | 63 | 53 | 15 | 220 | 5 |
| LITTLEFORD | 40 | 53 | 17 | 217 | 6.5 |

TONER WITH INCREASED SURFACE ADDITIVE ADHESION AND OPTIMIZED COHESION BETWEEN PARTICLES

CROSS-REFERENCE TO COPENDING APPLICATIONS

Attention is directed to commonly owned and assigned copending Applications Nos.: U.S. Ser. No. 09/943,951 filed Aug. 31, 2001 entitled "AN IMPROVED HIGH INTENSITY BLENDING TOOL WITH OPTIMIZED RISERS FOR INCREASED INTENSITY WHEN BLENDING TONERS".

BACKGROUND OF THE INVENTION

The field of the present invention relates to high intensity blending apparatus, particularly for blending operations designed to cause additive materials to become affixed to the surface of base particles. More particularly, the proposed invention relates to an improved blending tool for producing surface modifications to electrophotographic and related toner particles.

State of the art electrophotographic imaging systems increasingly call for toner particles having narrow distributions of sizes in ranges less than 10 microns. Along with such narrow distributions and small sizes, such toners require increased surface additive coverage since increased quantities of surface additives improve charge control properties, decrease adhesion between toner particles, and decrease Hybrid Scavangeless Development ("HSD") developer wire contamination in electrophotographic systems. The present invention enables an improved toner having greater coverage by surface additives and having greater adhesion of the surface additives to the toner particles. The present invention also relates to an improved method for producing surface modifications to electrophotographic and related toner particles. This method comprises using an improved blending tool to cause increased blending intensity during high speed blending processes.

A typical process for manufacture of electrophotographic, electrostatic or similar toners is demonstrated by the following description of a typical toner manufacturing process. For conventional toners, the process generally begins by melt-mixing the heated polymer resin with a colorant in an extruder, such as a Werner Pfleiderer ZSK-53 or WP-28 extruder, whereby the pigment is dispersed in the polymer. For example, the Werner Pfleiderer WP-28 extruder when equipped with a 15 horsepower motor is well-suited for melt-blending the resin, colorant, and additives. This extruder has a 28 mm barrel diameter and is considered semiworks-scale, running at peak throughputs of about 3 to 12 lbs./hour.

Toner colorants are particulate pigments or, alternatively, are dyes. Numerous colorants can be used in this process, including but not limited to:

| Pigment Brand Name | Manufacturer | Pigment Color Index |
|---|---|---|
| Permanent Yellow DHG | Hoechst | Yellow 12 |
| Permanent Yellow GR | Hoechst | Yellow 13 |
| Permanent Yellow G | Hoechst | Yellow 14 |
| Permanent Yellow NCG-71 | Hoechst | Yellow 16 |

-continued

| Pigment Brand Name | Manufacturer | Pigment Color Index |
|---|---|---|
| Permanent Yellow NCG-71 | Hoechst | Yellow 16 |
| Permanent Yellow GG | Hoechst | Yellow 17 |
| Hansa Yellow RA | Hoechst | Yellow 73 |
| Hansa Brilliant Yellow 5GX-02 | Hoechst | Yellow 74 |
| Dalamar .RTM. Yellow TY-858-D | Heubach | Yellow 74 |
| Hansa Yellow X | Hoechst | Yellow 75 |
| Novoperm .RTM. Yellow HR | Hoechst | Yellow 75 |
| Cromophtal .RTM. Yellow 3G | Ciba-Geigy | Yellow 93 |
| Cromophtal .RTM. Yellow GR | Ciba-Geigy | Yellow 95 |
| Novoperm .RTM. Yellow FGL | Hoechst | Yellow 97 |
| Hansa Brilliant Yellow 10GX | Hoechst | Yellow 98 |
| Lumogen .RTM. Light Yellow | BASF | Yellow 110 |
| Permanent Yellow G3R-01 | Hoechst | Yellow 114 |
| Cromophtal .RTM. Yellow 8G | Ciba-Geigy | Yellow 128 |
| lrgazin .RTM. Yellow 5GT | Ciba-Geigy | Yellow 129 |
| Hostaperm .RTM. Yellow H4G | Hoechst | Yellow 151 |
| Hostaperm .RTM. Yellow H3G | Hoechst | Yellow 154 |
| L74-1357 Yellow | Sun Chem. | |
| L75-1331 Yellow | Sun Chem. | |
| L75-2377 Yellow | Sun Chem. | |
| Hostaperm .RTM. Orange GR | Hoechst | Orange 43 |
| Paliogen .RTM. Orange | BASF | Orange 51 |
| Irgalite .RTM. 4BL | Ciba-Geigy | Red 57:1 |
| Fanal Pink | BASF | Red 81 |
| Quindo .RTM. Magenta | Mobay | Red 122 |
| Indofast .RTM. Brilliant Scarlet | Mobay | Red 123 |
| Hostaperm .RTM. Scarlet GO | Hoechst | Red 168 |
| Permanent Rubine F6B | Hoechst | Red 184 |
| Monastral .RTM. Magenta | Ciba-Geigy | Red 202 |
| Monastral .RTM. Scarlet | Ciba-Geigy | Red 207 |
| Heliogen .RTM. Blue L 6901F | BASF | Blue 15:2 |
| Heliogen .RTM. Blue NBD 7010 | BASF | |
| Heliogen .RTM. Blue K 7090 | BASF | Blue 15:3 |
| Heliogen .RTM. Blue K 7090 | BASF | Blue 15:3 |
| Paliogen .RTM. Blue L 6470 | BASF | Blue 60 |
| Heliogen .RTM. Green K 8683 | BASF | Green 7 |
| Heliogen .RTM. Green L 9140 | BASF | Green 36 |
| Monastral .RTM. Violet R | Ciba-Geigy | Violet 19 |
| Monastral .RTM. Red B | Ciba-Geigy | Violet 19 |
| Quindo .RTM. Red R6700 | Mobay | |
| Quindo .RTM. Red R6713 | Mobay | |
| lndofast .RTM. Violet | Mobay | Violet 23 |
| Monastral .RTM. Violet Maroon B | Ciba-Geigy | Violet 42 |
| Sterling .RTM. NS Black | Cabot | Black 7 |
| Sterling .RTM. NSX 76 | Cabot | |
| Tipure .RTM. R-101 | Du Pont | |
| Mogul L | Cabot | |
| BK 8200 Black Toner | Paul Uhlich | |

Any suitable toner resin can be mixed with the colorant by the downstream injection of the colorant dispersion. Examples of suitable toner resins which can be used include but are not limited to polyamides, epoxies, diolefins, polyesters, polyurethanes, vinyl resins and polymeric esterification products of a dicarboxylic acid and a diol comprising a diphenol.

Illustrative examples of suitable toner resins selected for the toner and developer compositions of the present invention include vinyl polymers such as styrene polymers, acrylonitrile polymers, vinyl ether polymers, acrylate and methacrylate polymers; epoxy polymers; diolefins; polyurethanes; polyamides and polyimides; polyesters such as the polymeric esterification products of a dicarboxylic acid and a diol comprising a diphenol, crosslinked polyesters; and the like. The polymer resins selected for the toner compositions of the present invention include homopolymers or copolymers of two or more monomers. Furthermore, the above-mentioned polymer resins may also be crosslinked.

Illustrative vinyl monomer units in the vinyl polymers include styrene, substituted styrenes such as methyl styrene, chlorostyrene, styrene acrylates and styrene methacrylates; vinyl esters like the esters of monocarboxylic acids including methyl acrylate, ethyl acrylate, n-butylacrylate, isobutyl acrylate, propyl acrylate, pentyl acrylate, dodecyl acrylate, n-octyl acrylate, 2-chloroethyl acrylate, phenyl acrylate, methylalphachloracrylate, methyl methacrylate, ethyl methacrylate, butyl methacrylate, propyl methacrylate, and pentyl methacrylate; styrene butadienes; vinyl chloride; acrylonitrile; acrylamide; alkyl vinyl ether and the like. Further examples include p-chlorostyrene vinyl naphthalene, unsaturated mono-olefins such as ethylene, propylene, butylene and isobutylene; vinyl halides such as vinyl chloride, vinyl bromide, vinyl fluoride, vinyl acetate, vinyl propionate, vinyl benzoate, and vinyl butyrate; acrylonitrile, methacrylonitrile, acrylamide, vinyl ethers, inclusive of vinyl methyl ether, vinyl isobutyl ether, and vinyl ethyl ether; vinyl ketones inclusive of vinyl methyl ketone, vinyl hexyl ketone and methyl isopropenyl ketone; vinylidene halides such as vinylidene chloride and vinylidene chlorofluoride; N-vinyl indole, N-vinyl pyrrolidone; and the like Illustrative examples of the dicarboxylic acid units in the polyester resins suitable for use in the toner compositions of the present invention include phthalic acid, terephthalic acid, isophthalic acid, succinic acid, glutaric acid, adipic acid, pimelic acid, suberic acid, azelaic acid, sebacic acid, maleic acid, fumaric acid, dimethyl glutaric acid, bromoadipic acids, dichloroglutaric acids, and the like; while illustrative examples of the diol units in the polyester resins include ethanediol, propanediols, butanediols, pentanediols, pinacol, cyclopentanediols, hydrobenzoin, bis(hydroxyphenyl) alkanes, dihydroxybiphenyl, substituted dihydroxybiphenyls, and the like.

In one toner resin, there are selected polyester resins derived from a dicarboxylic acid and a diphenol. These resins are illustrated in U.S. Pat. No. 3,590,000, the disclosure of which is totally incorporated herein by reference. Also, polyester resins obtained from the reaction of bisphenol A and propylene oxide, and in particular including such polyesters followed by the reaction of the resulting product with fumaric acid, and branched polyester resins resulting from the reaction of dimethylterephthalate with 1,3-butanediol, 1,2-propanediol, and pentaerythritol may also preferable be used. Further, low melting polyesters, especially those prepared by reactive extrusion, reference U.S. Pat. No. 5,227,460, the disclosure of which is totally incorporated herein by reference, can be selected as toner resins. Other specific toner resins may include styrene-methacrylate copolymers, styrenebutadiene copolymers, PLIOLITES™, and suspension polymerized styrenebutadienes (U.S. Pat. No. 4,558,108, the disclosure of which is totally incorporated herein by reference).

More preferred resin binders for use in the present invention comprise polyester resins containing both linear portions and cross-linked portions of the type described in U.S. Pat. No. 5,227,460 (incorporated herein by reference above).

The resin or resins are generally present in the resin-toner mixture in an amount of from about 50 percent to about 100 percent by weight of the toner composition, and preferably from about 80 percent to about 100 percent by weight.

Additional "internal' components of the toner may be added to the resin prior to mixing the toner with the additive. Alternatively, these components may be added during extrusion. Various known suitable effective charge control additives can be incorporated into toner compositions, such as quaternary ammonium compounds and alkyl pyridinium compounds, including cetyl pyridinium halides and cetyl pyridinium tetrafluoroborates, as disclosed in U.S. Pat. No. 4,298,672, the disclosure of which is totally incorporated herein by reference, distearyl dimethyl ammonium methyl sulfate, and the like. The internal charge enhancing additives are usually present in the final toner composition in an amount of from about 0 percent by weight to about 20 percent by weight.

After the resin, colorants, and internal additives have been extruded, the resin mixture is reduced in size by any suitable method including those known in the art. Such reduction is aided by the brittleness of most toners which causes the resin to fracture when impacted. This allows rapid particle size reduction in pulverizers or attritors such as media mills, jet mills, hammer mills, or similar devices. An example of a suitable jet mill is an Alpine 800 AFG Fluidized Bed Opposed Jet Mill. Such a jet mill is capable of reducing typical toner particles to a size of about 4 microns to about 30 microns. For color toners, toner particle sizes may average within an even smaller range of 4–10 microns.

Inside the jet mill, a classification process sorts the particles according to size. Particles classified as too large are rejected by a classifier wheel and conveyed by air to the grinding zone inside the jet mill for further reduction. Particles within the accepted range are passed onto the next toner manufacturing process.

After reduction of particle size by grinding or pulverizing, a classification process sorts the particles according to size. Particles classified as too fine are removed from the product eligible particles. The fine particles have a significant impact on print quality and the concentration of these particles varies between products. The product eligible particles are collected separately and passed to the next toner manufacturing process.

After classification, the next typical process is a high speed blending process wherein surface additive particles are mixed with the classified toner particles within a high speed blender. These additives include but are not limited to stabilizers, waxes, flow agents, other toners and charge control additives. Specific additives suitable for use in toners include fumed silica, silicon derivatives, ferric oxide, hydroxy terminated polyethylenes, polyolefin waxes, including polyethylenes and polypropylenes, polymethylmethacrylate, zinc stearate, chromium oxide, aluminum oxide, titanium oxide, stearic acid, and polyvinylidene fluorides.

The amount of external additives is measured in terms of percentage by weight of the toner composition, and the additives themselves are not included when calculating the percentage composition of the toner. For example, a toner composition containing a resin, a colorant, and an external additive may comprise 80 percent by weight resin and 20 percent by weight colorant. The amount of external additive present is reported in terms of its percent by weight of the combined resin and colorant. The combination of smaller toner particle sizes required by some newer color toners and the increased size and coverage of additive particles for such color toners increases the need for high intensity blending.

The above additives are typically added to the pulverized toner particles in a high speed blender such as a Henschel Blender FM-10, 75 or 600 blender. The high intensity blending serves to break additive agglomerates into the appropriate nanometer size, evenly distribute the smallest possible additive particles within the toner batch, and attach the smaller additive particles to toner particles. Each of these processes occurs concurrently within the blender. Additive particles become attached to the surface of the pulverized toner particles during collisions between particles and between particles and the blending tool as it rotates. It is believed that such attachment between toner particles and surface additives occurs due to both mechanical impaction and electrostatic attractions. The amount of such attachments is proportional to the intensity level of blending which, in turn, is a function of both the speed and shape of the blending tool. The amount of time used for the blending process plus the intensity determines how much energy is applied during the blending process. For an efficient blending tool that avoids snow plowing and excessive vortices and low density regions, "intensity" can be effectively measured by reference to the power consumed by the blending motor per unit mass of blended toner (typically expressed as Watts/lb). Using a standard Henschel Blender tool to manufacture conventional toners, the blending times typically range from one (1) minute to twenty (20) minutes per typical batch of 1–500 kilograms. For certain more recent toners such as toners for Xerox Docucenter 265 and related multifunctional printers, blending speed and times are increased in order to assure that multiple layers of surface additives become attached to the toner particles. Additionally, for those toners that require a greater proportion of additive particles in excess of 25 nanometers, more blending speed and time is required to force the larger additives into the base resin particles. More details of the problem are disclosed in effect is disclosed in U.S. Application Ser. No. 09/258,271, entitled "AN IMPROVED TONER WITH INCREASED AMOUNT OF SURFACE ADDITIVES AND INCREASED SURFACE ADDITIVE ADHESION", filed Dec. 27, 2000, and hereby incorporated by reference.

The process of manufacturing toners is completed by a screening process to remove toner agglomerates and other large debris. Such screening operation may typically be performed using a Sweco Turbo screen set to 37 to 105 micron openings.

The above description of a process to manufacture an electrophotographic toner may be varied depending upon the requirements of particular toners. In particular, for full process color printing, colorants typically comprise yellow, cyan, magenta, and black colorants added to separate dispersions for each color toner. Colored toner typically comprises much smaller particle size than black toner, in the order of 4–10 microns. The smaller particle size makes the manufacturing of the toner more difficult with regard to material handling, classification and blending.

The above described process for making electrophotographic toners is well known in the art. More information concerning methods and apparatus for manufacture of toner are available in the following U.S. patents, each of the disclosures of which are incorporated herein: U.S. Pat. No. 4,338,380 issued to Erickson, et al; U.S. Pat. No. 4,298,672 issued to Chin; U.S. Pat. No. 3,944,493 issued to Jadwin; U.S. Pat. No. 4,007,293 issued to Mincer, et al; U.S. Pat. No. 4,054,465 issued to Ziobrowski; U.S. Pat. No. 4,079,014 issued to Burness, et al; U.S. Pat. No. 4,394,430 issued to Jadwin, et al; U.S. Pat. No. 4,433,040 issued to Niimura, et al; U.S. Pat. No. 4,845,003 issued to Kiriu, et al; U.S. Pat. No. 4,894,308 issued to Mahabadi et al.; U.S. Pat. No. 4,937,157 issued to Haack, et al; U.S. Pat. No. 4,937,439 issued to Chang et al.; U.S. Pat. No. 5,370,962 issued to Anderson, et al; U.S. Pat. No. 5,624,079 issued to Higuchi et al.; U.S. Pat. No. 5,716,751 issued to Bertrand et al.; U.S. Pat. No. 5,763,132 issued to Ott et al.; U.S. Pat. No. 5,874,034 issued to Proper et al.; and U.S. Pat. No. 5,998,079 issued to Tompson et al.;.

In addition to the above conventional process for manufacturing toners, other methods for making toners may also be used. In particular, emulsion/aggregation/coalescence processes (the "EA process") for the preparation of toners are illustrated in a number of Xerox Corporation patents, the disclosures of each of which are totally incorporated herein by reference, such as U.S. Pat. No. 5,290,654, U.S. Pat. No. 5,278,020, U.S. Pat. No. 5,308,734, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797; and also of interest may be U.S. Pat. Nos. 5,348,832; 5,405,728; 5,366,841; 5,496,676; 5,527,658; 5,585,215; 5,650,255; 5,650,256; 5,501,935; 5,723,253; 5,744,520; 5,763,133; 5,766,818; 5,747,215; 5,827,633; 5,853,944; 5,804,349; 5,840,462; 5,869,215; 5,863,698; 5,902,710; 5,910,387; 5,916,725; 5,919,595; 5,925,488, and 5,977,210. The appropriate components and processes of the above Xerox Corporation patents can be selected for the processes of the present invention in embodiments thereof. In both the above described conventional process and in processes such as the EA process, surface additive particles are added using high intensity blending processes.

High speed blending of dry, dispersed, or slurried particles is a common operation in the preparation of many industrial products. Examples of products commonly made using such high-speed blending operations include, without limitation, paint and colorant dispersions, pigments, varnishes, inks, pharmaceuticals, cosmetics, adhesives, food, food colorants, flavorings, beverages, rubber, and many plastic products. In some industrial operations, the impacts created during such high-speed blending are used both to uniformly mix the blend media and, additionally, to cause attachment of additive chemicals to the surface of particles (including resin molecules or conglomerates of resins and particles) in order to impart additional chemical, mechanical, and/or electrostatic properties. Such attachment between particles is typically caused by both mechanical impaction and electrostatic bonding between additives and particles as a result of the extreme pressures created by particle/additive impacts within the blender device. Among the products wherein attachments between particles and/or resins and additive particles are important during at least one stage of manufacture are paint dispersions, inks, pigments, rubber, and certain plastics.

High intensity blending typically occurs in a blending machine, and the blending intensity is greatly influenced by the shape and speed of the blending tool used in the blending process. A typical blending machine and blending tool of the prior art is exemplified in FIGS. 1 and 2. FIG. 1 is a schematic elevational view of a blending machine 2. Blending machine 2 comprises a vessel 10 into which materials to be mixed and blended are added before or during the blending process. Housing base 12 supports the weight of vessel 10 and its contents. Motor 13 is located within housing base 12 such that its drive shaft 14 extends vertically through an aperture in housing 12. Shaft 14 also extends into vessel 10 through sealed aperture 15 located at the bottom of vessel 10. Upon rotation, shaft 14 has an axis of rotation that generally is orthogonal to the bottom of vessel 10. Shaft 14 is fitted with a locking fixture 17 at its end, and blending tool 16 is rigidly attached to shaft 14 by locking fixture 17. Before blending is commenced, lid 18 is lowered and fastened onto vessel 10 to prevent spillage. For high intensity blending, the speed of the rotating tool at its outside edge generally exceeds 50 ft./second. The higher the speed, the more intense, and tool speeds in excess of 90 ft./second, or 120 ft./second are common.

Various shapes and thicknesses of blending tools are possible. Various configurations are shown in the brochures and catalogues offered by manufacturer's of high-speed blending equipment such as Henschel, Littleford Day Inc., and other vendors. The tool shown in FIG. 1 is based upon a tool for high intensity blending produced by Littleford Day, Inc. and is discussed in more detail in relation to FIG. 3 discussed below. Among the reasons for different configurations of blending tools are (i) different viscosities often require differently shaped tools to efficiently utilize the power and torque of the blending motor; and (ii) different blending applications require different intensities of blending. For instance, some food processing applications may require a very fine distribution of small solid particles such as colorants and flavorings within a liquid medium. As another example, the processing of snow cones requires rapid and very high intensity blending designed to shatter ice cubes into small particles which are then mixed within the blender with flavored syrups to form a slurry.

As discussed more fully below, the shape of blending tool 16 greatly affects the intensity of blending. One type of tool design attempts to achieve high intensity blending by enlarging collision surfaces, thereby increasing the number of collisions per unit of time, or intensity. One problem with this type of tool is that particles tend to become stuck to the front part of the tool, thereby decreasing efficiency and rendering some particles un-mixed. An example of an improved tool using an enlarged collision surface that attempt to overcome this "snow-plowing" effect is disclosed in U.S. application Ser. No. 09/748,920, entitled "BLENDING TOOL WITH AN ENLARGED COLLISION SURFACE FOR INCREASED BLEND INTENSITY AND METHOD OF BLENDING TONERS, filed Dec. 27, 2000, hereby incorporated by reference. Even when overcoming the "snow-plow" effect, a second limitation of prior art tools with enlarged collision surfaces is that particles in the blender tend to swirl in the direction and nearly at the speed of the moving tool. Thus, the impact speed between the tool and a statistical average of particles moving within vessel 10 is less than the speed of the tool itself since the particles generally are moving in the same direction as the tool.

Another type of a blending tool that is more typically used for blending toners and additives is shown in FIG. 2 as tool 26. As shown, tool 26 comprises 3 wing shaped blades, each arranged orthoganally to the blade immediately above and/or below it. Tool 26 as shown has blades 27, 28, and 29. Blade 27, the bottom blade, is generally called "the scraper" and serves to lift particles from the bottom and provide initial motion to the particles. Blade 28, the middle blade, is called "the fluidizing tool" and serves to provide additional mechanical energy to the mixture. Blade 29, the top blade, is called the "horn tool" and is usually bent upward at an angle. The horn tool 29 is the blade primarily responsible for mixing and inducing/providing impact energy between toner and additive particles. Since tool 26 is designed such that each of its separate blades are relatively thin and therefore flow through the toner and additive mixture without accretion of particles on the leading edges, measure of the power consumed by the blending motor is a good indicator of the intensity of blending that occurs during use of the tool. This power consumption is measured as the specific power of a tool, defined as follows:

$$\text{Specific Power} = \frac{\text{Load Power} - \text{No Load Power}}{\text{Batch Weight}} \text{ [Watt/lb.]}$$

The Specific Power of tool 26 is shown in FIGS. 9 and 10 in relation to different speeds of rotation. The significance of the data shown in FIGS. 9 and 10 is discussed below when describing advantages of an embodiment of the present invention. It should be noted, however, that tool 26 also embodies the limitation described above wherein the actual collision energy between particles is usually less than the speed of the tool itself since each of blades 27, 28, an 29 have the effect of swirling particles within the blending vessel in the direction of tool rotation.

At least one tool in the prior art appears designed to achieve blend intensity through creation of vortices and shear forces. This tool is sold by Littleford Day Inc. for use in its blenders and appears in cross-section as tool 16 in FIG. 1. As shown in perspective view in FIG. 3, the Littleford tool 16 has center shank 20 with a central bushing fixture 17A for engagement with locking fixture 17 at the end of shaft 14 (both fixture 17 and shaft 14 are shown in FIG. 1). Bushing fixture 17A includes a notch conforming to a male locking key feature on locking fixture 17 (from FIG. 1). Arrow 21 shows the direction in which tool 16 rotates upon shaft 14. A second scraper blade 16A may be mounted below tool 16 onto shaft 14 as shown in FIG. 3. In the configuration shown, the Littleford scraper blade 16A comprises a shank mounted orthogonally to center shank 20 that emerges from underneath shank 20 in an essentially horizontal manner and then dips downward near its end region. The end region of blade 16A is shaped into a flat club shape with a leading edge near the bottom of the blending vessel (not shown) and the trailing edge sloping slightly upward to impart lift to particles scraped from the bottom of the vessel. The leading edge of the club shape runs from an outside corner nearest the blending vessel wall inwardly towards the general direction of shaft 14. The scraper blades are shorter than shank 20, and the combination of this shorter length plus the shape of the leading edge indicates that the function of the Littleford scraper blade is directed toward lifting particles in the middle of the blending vessel upward from the bottom of the vessel.

In contrast to the tool shown in FIG. 2, tool 16 comprises vertical risers 19A and 19B that are fixed to the end of center shank 20 at its point of greatest velocity during rotation around central bushing 17A. These vertical risers 19A and 19B are angled, or canted, in relation to the axis of center shank 20 at an angle of 17 degrees. In this manner, the leading edges 21A and 21B of risers 19A and 19B are proximate the wall of blending vessel 10 (from FIG. 1) while the trailing edges 22A and 22B are further removed from vessel wall 10. Applicant believes that tool 16 operates by creating shear forces between particles caught in the space created between the outside surface of risers 19A and 19B and the wall of vessel 10. Since trailing edges 22B and 22A are further removed from the wall, a vortex is created in this space. It is believed that particles trapped in these vortices follow the tool at or nearly at the speed of leading edges 19A and 19B. In contrast, particles that have slipped through gap between leading edge 19A and 19B and the wall of vessel 10 remain nearly stationary. When particles swept along within the vortices behind leading edges 19A and 19B impact the nearly stationary particles along the vessel wall, then the speed of collision is at or nearly at the speed of the leading edges of the tool. Applicant has not found literature that describes the above effects. Instead, the above analysis results from Applicants' own investigation of blending tools.

As described above, the process of blending plays an increasingly important role in the manufacture of electrophotographic and similar toners. It would be advantageous if an apparatus and method were found to accelerate the blending process and to thereby diminish the time and cost required for blending. Lastly, it would be advantageous to create a blending process that enables an improved toner having a greater quantity of surface additives than heretofore manufactured and having such additives adhere to toner particles with greater force than heretofore manufactured. Such an improved toner would enable improved charge-through characteristics, less cohesion between toner particles, and less contamination of development wires in toner imaging systems using hybrid development technology.

SUMMARY OF THE INVENTION

One aspect of the present invention is an improved toner comprising: (a) a colorant; (b) a toner resin mixed with the colorant and formed into combined colorant and resin particles having an average size less than 15 microns; and (c) surface additive particles wherein the surface additives are adhered to the colorant and toner resin by an impaction process in a quantity greater than three (3) percent of the combined weight of resin and colorant in the toner.

Another aspect of the present invention is an improved toner made by an improved process, comprising: (a) forming toner particles averaging 4 to 10 microns in size and comprised of at least one toner resin and at least one colorant; and (b) blending sufficient surface additive particles and the toner particles in a high intensity blender for less than 10 minutes such that the weight of surface additives that become attached to toner particles is greater than three (3) percent of the weight of the classified particles Yet another aspect of the present invention is an improved process for making toners, comprising: (a) forming toner particles averaging 4 to 10 microns in size and comprised of at least one toner resin and at least one colorant; and (b) blending sufficient surface additive particles and the toner particles in a high intensity blender for less than 10 minutes such that the weight of surface additives that become attached to toner particles is greater than three (3) percent of the weight of the classified particles

BRIEF DESCRIPTION OF THE DRAWINGS

Other aspects of the present invention will become apparent as the following description proceeds and upon reference to the drawings, in which.

DETAILED DESCRIPTION OF THE DRAWINGS

While the present invention will hereinafter be described in connection with its preferred embodiments and methods of use, it will be understood that it is not intended to limit the invention to these embodiments and method of use. On the contrary, the following description is intended to cover all alternatives, modifications, and equivalents, as may be included within the spirit and scope of the invention as defined by the appended claims.

One aspect of the present invention is creation of a blending tool capable of generating more intensity than heretofore possible. This increased intensity is the result of increased shear forces with resulting higher differentials in velocities among particles that impact each other in the shear zone. This increased differential in velocity between colliding particles allows blending time to be decreased, thereby saving batch costs and increasing productivity. Such increased differential in velocities also produces improved toners by both increasing the quantity of additive particles adhering to toner particles and by increasing the average forces of adhesion between additive particles and toner particles.

Figure 4:
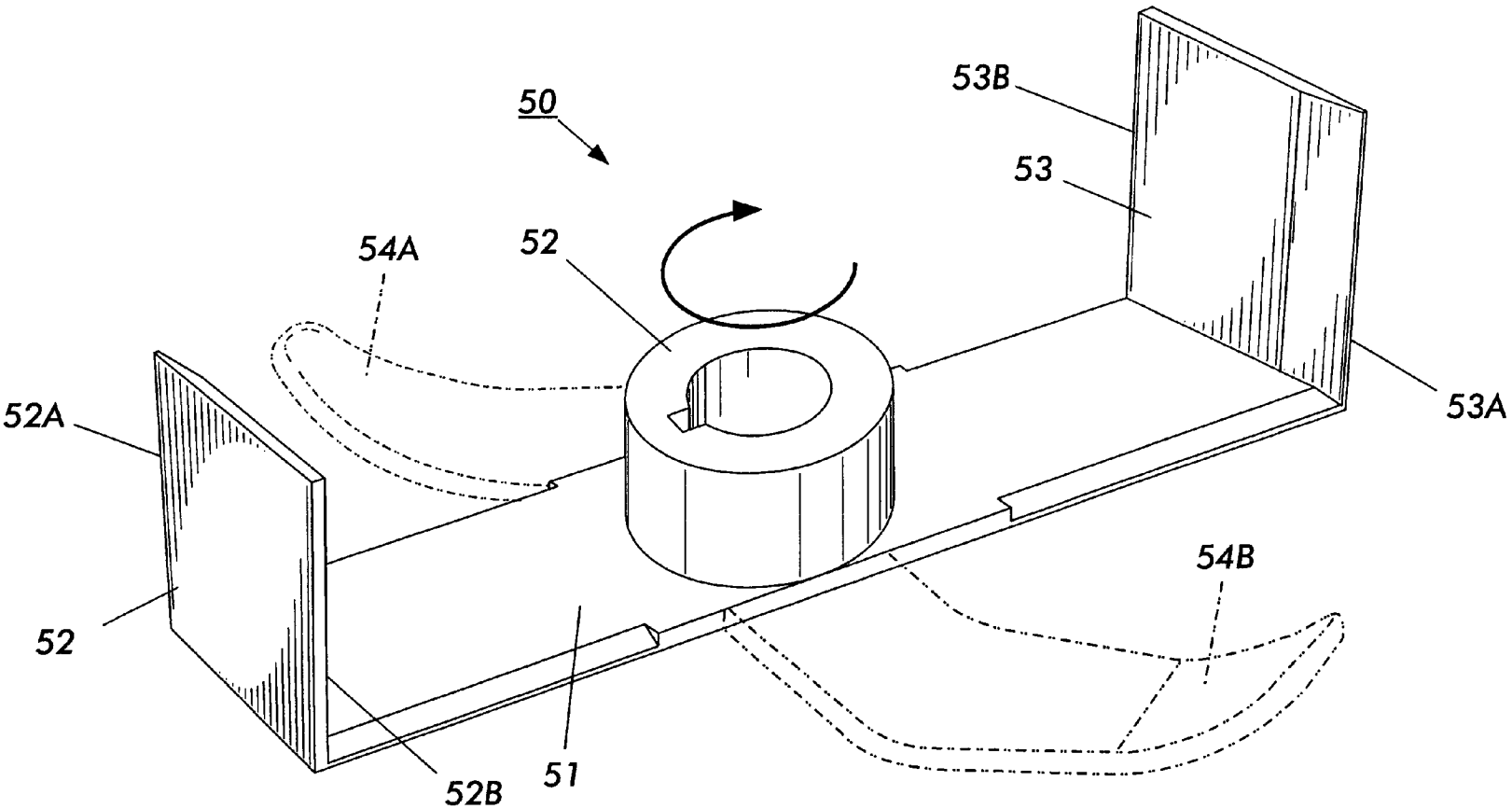
FIG. 4 is a perspective view of an embodiment of the blending tool arrangements of the present invention.

Accordingly, blending tool 50 as shown in FIG. 4 is an embodiment of the present invention. Center shank 51 of tool 50 contains locking fixture 52 at its middle for mounting onto a rotating drive shaft such as shaft 14 of the blending machine 2 in FIG. 1. Vertical risers 52 and 53 are attached at each end of shank 51.

Figure 3:
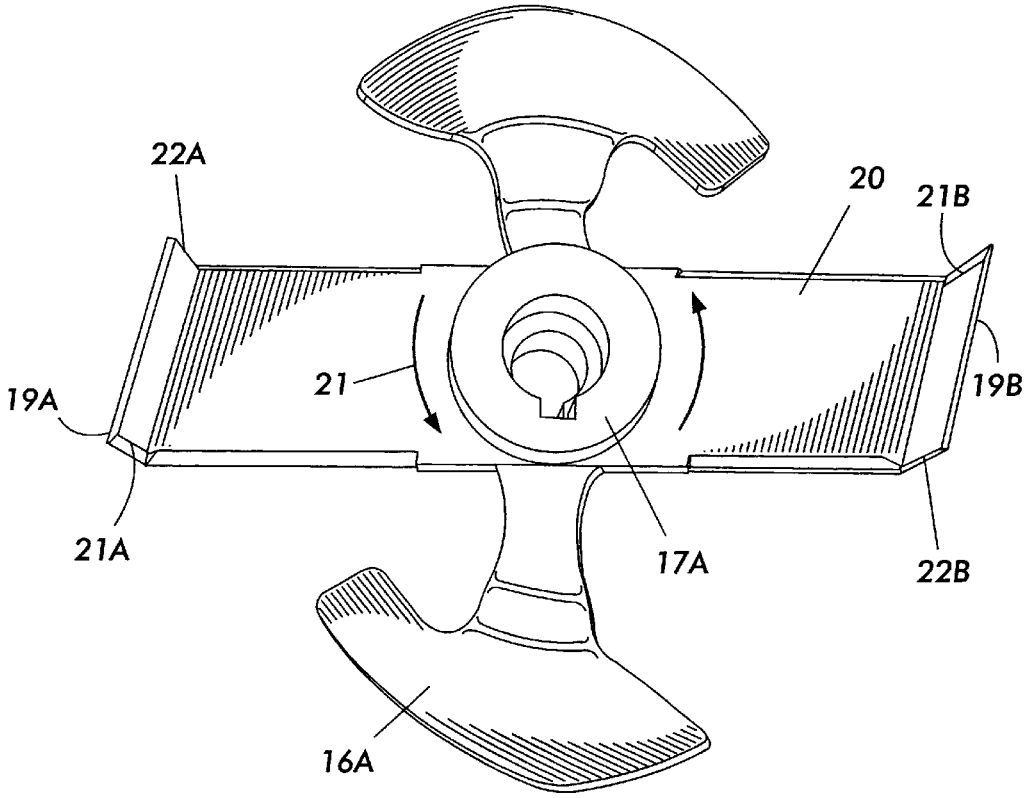
FIG. 3 PRIOR ART
FIG. 3 is a perspective view of a second blending tool of the prior art.
Figure 5:
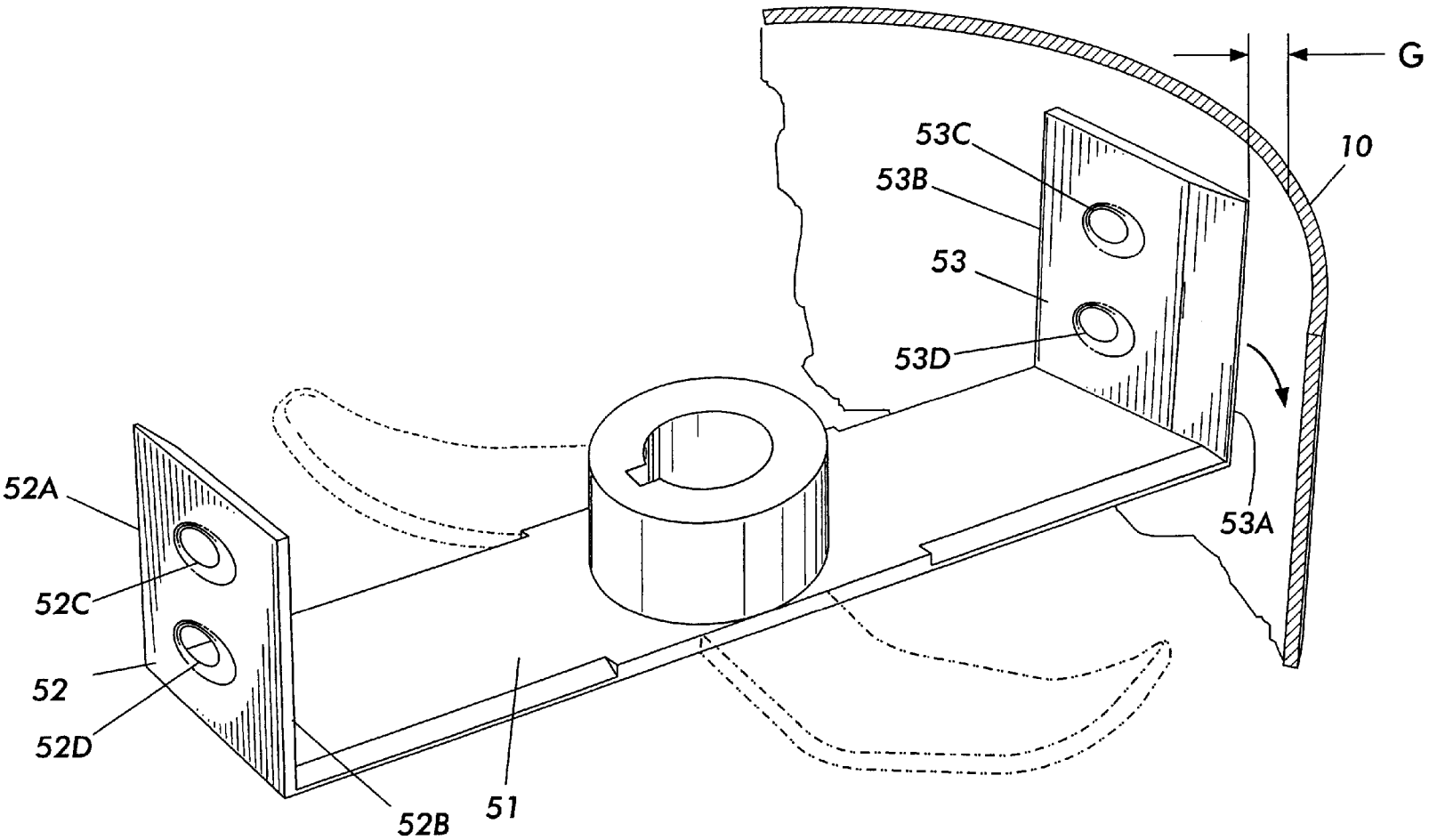
FIG. 5 is a perspective view of an embodiment of the blending tool arrangements of the present invention placed within a blending vessel.

In a manner similar to the Littleford tool shown in FIG. 3, vertical risers 52 and 53 are angled, or canted, in relation to the plane perpendicular to the long axis of shank 51. Leading edges 52A and 53A are closer to the blending vessel wall than trailing edges 52B and 53B. The result is that the outside surface (shown as 55 in FIG. 6) of riser 52 has a forward region (shown as 56 in FIG. 6) proximate to leading edge 52A that is angled outward from the axis of center shank 51. FIG. 5 shows this effect, with the gap, G, between leading edge 53A and the wall of vessel 10 being approximately 5 millimeters when tool 50 is sized for a 10 liter blending vessel. Particles that pass within this gap, g, remain relatively stationary in relation to the wall of vessel 10. Once leading edge 53A has swept past a particular particle in gap G, however, then it becomes subject to vortices formed along the outside surface of riser 53. These vortices form because riser 53 angles away from the wall of vessel 10, thereby inducing a partial vacuum in the space between the outside surface of riser 53 and vessel wall 10. Some particles remain "trapped" within these vortices and are swept along at speeds approximating the velocity of riser 53 itself. The highest impact energies between particles occur when these swept along particles traveling at nearly the speed of riser 53 impact nearly stationary particles that had slipped through gap G. The number of these collisions is greatly increased by the angle of riser 53 in relation to shank 51 since the induced vortices tend to pull the nearly stationary particles towards riser 53.

Figures 6, 7:
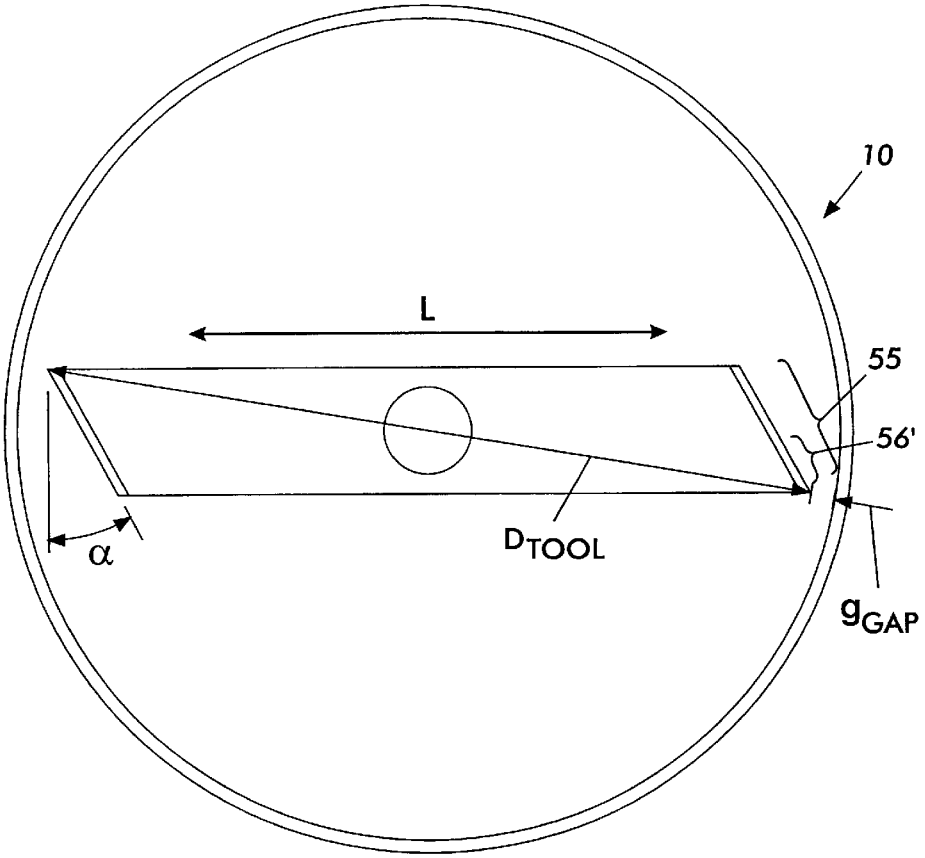
FIG. 6 is a vertical overhead view of the footprint of an embodiment the present invention when placed into a blending vessel.
FIG. 7 is a chart of various dimensions of an embodiment of a blending tool of the present invention compared to similar dimensions of a tool of the prior art.

A comparison of the specific dimensions of tool 50 of the present invention and the Littleford tool shown in FIG. 3 shows a series of differences resulting in improvements under the present invention. Turning to FIG. 6, an elevated vertical view shows the footprint outline of both tool 50 and the Littleford tool as viewed from above. In both tools, risers are mounted at the ends, or tips, or the tool. The angle between the plane perpendicular to the long axis of the shank and the placement of the risers is labeled as angle $\alpha$. The diagonal dimension across the tool shank is labeled $D_{TOOL}$. Gap G is identified as shown. The outside surface of the riser is shown as 55, and the forward region of the outside surface is shown as 56. The long axis of shank 51 is shown as double headed arrow L.

Figure 2:
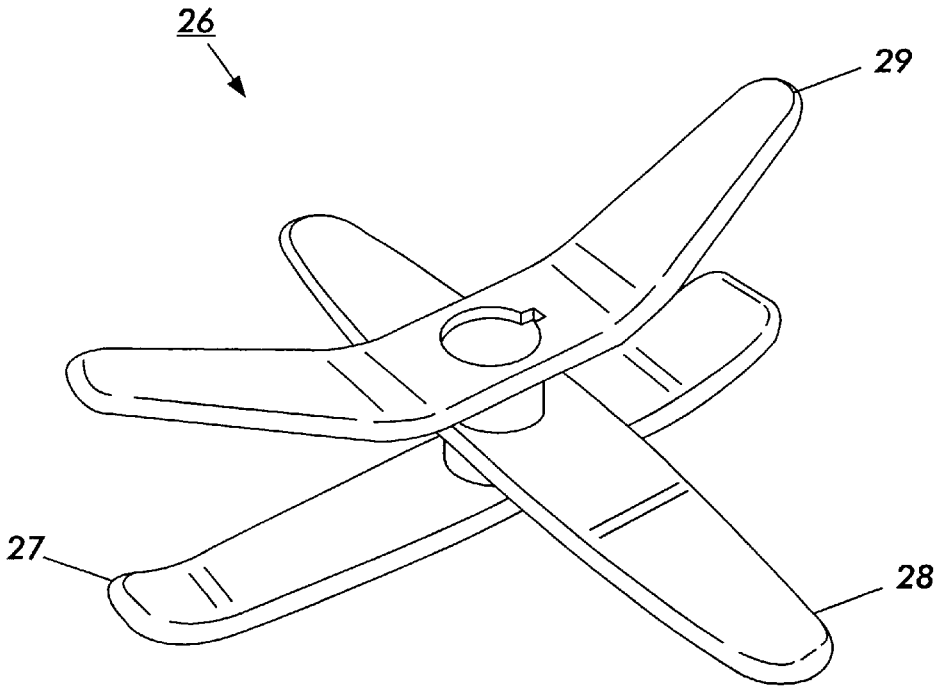
FIG. 2 PRIOR ART
FIG. 2 is a perspective view of a blending tool of the prior art.

Turning now to FIG. 7, a comparison between the dimensions of tool 50 of the present invention and the Littleford tool shown in FIG. 3 is shown for tools designed for standard 10 liter blending vessels. Littleford does not make a riser tool such as shown in FIG. 2 for a 75 liter vessel but such a riser feature is available at a 1200 liter scale. (Vessels of 75, 600, and 1200 liters are production size vessels for toner blending.) As shown, angle $\alpha$ of tool 50 is 15 degrees whereas angle $\alpha$ of the Littleford tool is 17 degrees. The significance of this difference is discussed below. Dimension $D_{Tool}$ also differs: tool 50 is longer than the Littleford tool by 3 millimeters. As a result of this longer diagonal dimension, risers 52 and 53 of tool 50 reach greater tip velocities than the comparable risers of the Littleford tool at the same rate of rotation. Also as a result of a longer diagonal dimension, the gap G for tool 50 is 5 millimeters whereas the gap G of the Littleford tool is 6.5 millimeters. Also shown in FIG. 7 is a comparison of the difference in height of the risers in tool 50 and the Littleford tool: 63 millimeters for tool 50 vs. 40 millimeters for the Littleford tool. The ratio of $H_{TOOL}/D_{TOOL}$ for tool 50 is 63/220, or 0.286, whereas $H_{Tool}/D_{Tool}$ for the Littleford tool is 40/217, or 0.184. For 75 liter configurations of tool 50, this ratio of $H_{Tool}/D_{Tool}$ for a tool of the present invention configured such as tool 50 is the same as the 0.286 ratio of the 10 liter tool.

Figure 8:
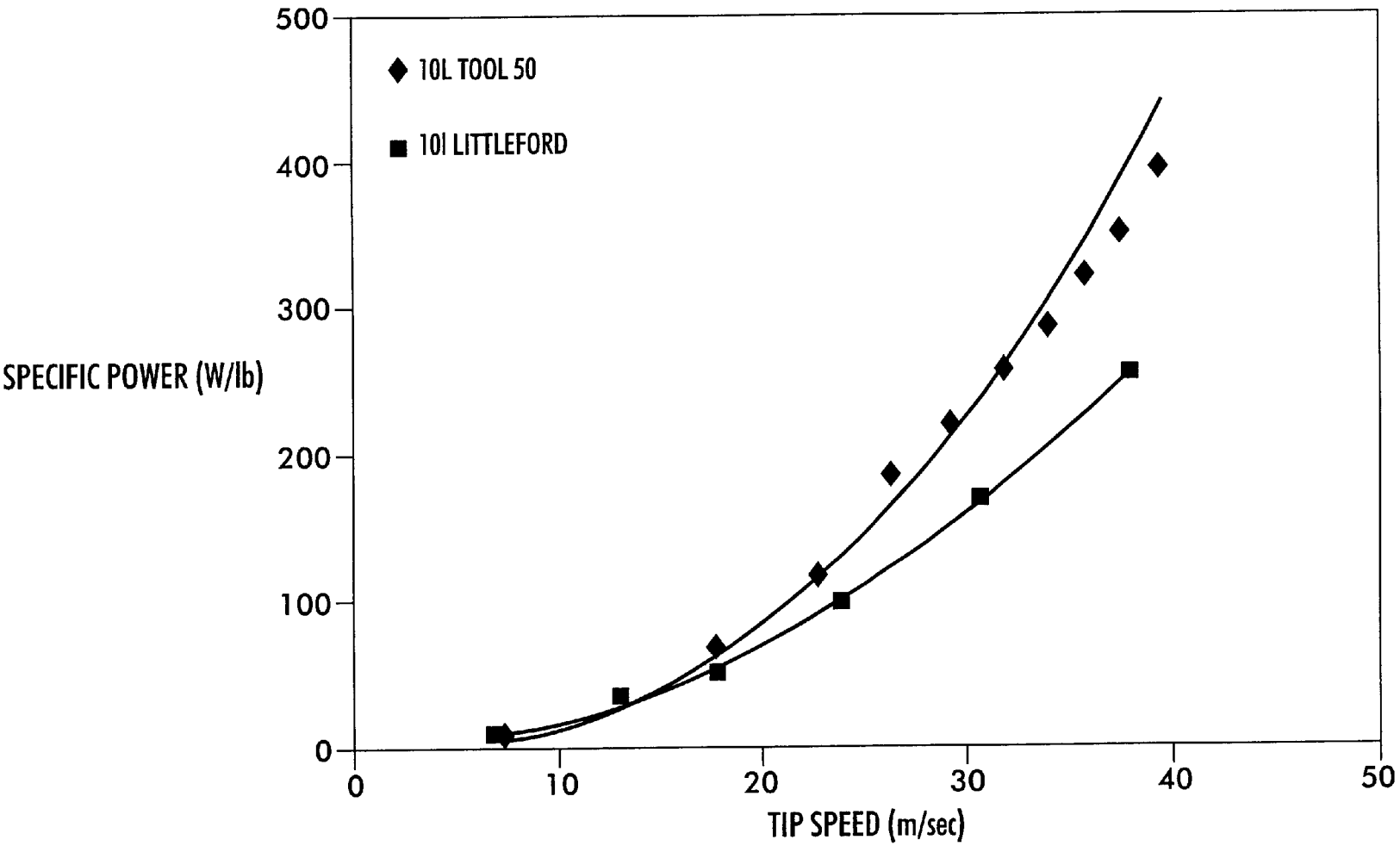
FIG. 8 is a graph showing specific power values varying with tool tip speed for several blending tools.

The net effect of the above differences in $D_{Tool}$ and $\alpha$ is demonstrated in the Specific Power comparison curves shown in FIG. 8. This comparison data was generated using the 10 liter Littleford tool and a 10 liter tool of the present invention with approximately the same height as the Littleford tool. (A larger Littleford riser tool is not made.) The experiment was designed to measure the effect of decreasing angle $\alpha$ and increasing $D_{Tool}$. The Y-axis in the graph of FIG. 8 lists a series of Specific Power measures. The X-axis lists various tip speeds of the tool. Toner particles being blended averaged 4 to 10 microns and surface additive particles averaged 30–50 nanometers. As shown, tool 50 outperforms the Littleford tool with increasing efficiencies as tip speed increases. Thus, the decrease in angle $\alpha$ from 17 to 15 degrees and the increase in the $D_{Tool}$ diagonal dimension are significant contributors to the performance of tool 50. In particular, the decrease in angle $\alpha$ is believed to be the more significant contributor. The optimal blending occurs when $\alpha$ is between 10 and 16 degrees and, more preferably, between 14 and 15.5 degrees.

Figure 9:
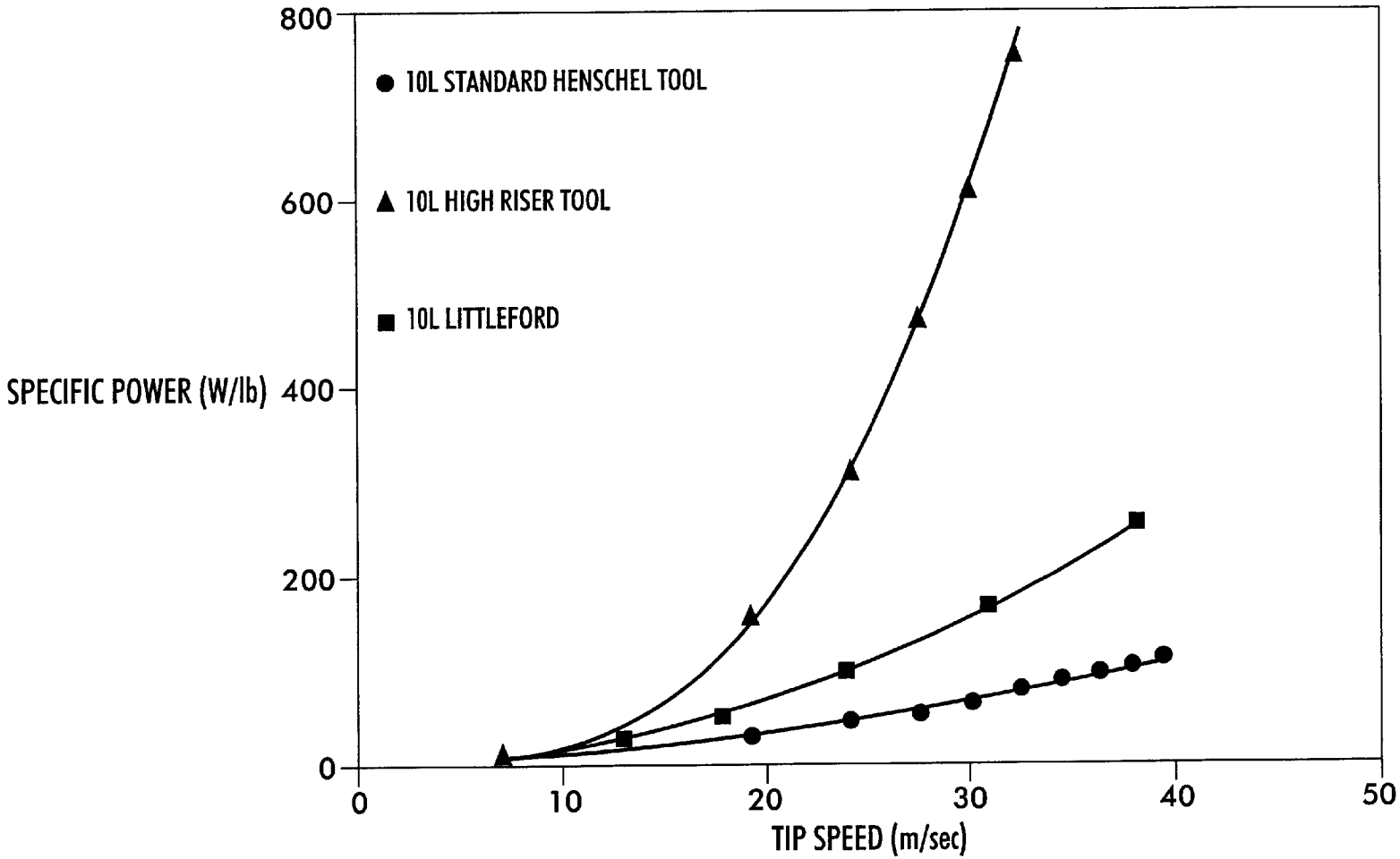
FIG. 9 is a graph showing specific power values varying with tool tip speed for several blending tools mounted within a 10 liter blender.

Turning now to FIG. 9, an overall comparison of the Specific Power of tool 50 with full-height risers is shown in comparison to the standard Henschel blending tool described in relation to FIG. 2 as well as the standard Littleford tool shown in FIG. 3. All tools were for a 10 liter blending vessel since the Littleford tool is not made for the larger 75 liter vessel. As with FIG. 8, the Y-axis in FIG. 9 lists a series of Specific Power measures. The X-axis lists various tip speeds of the tool. Toner particles being blended averaged 4 to 10 microns and surface additive particles averaged 30–50 nanometers. As shown, tool 50 of the present invention greatly outperforms both standard prior art tools, especially as tip speeds increase above 15 meters/second. In a typical blend operation, tip speeds usually reach up to 40 meter/second for a 10 liter vessel. Thus, the improvements in the present invention over the prior art significantly increase the blending intensity of the tool. This increase in intensity has a number of beneficial effects, including, without limitation, a decrease in time necessary to perform the blending operation. For instance, use of a tool of the present invention is expected to decrease batch time over use of the conventional Henschel tool shown in FIG. 2 by at least 50–75 percent in a 75 liter or 600 liter vessel. Additionally, as discussed below, increased blend intensity improves such important toner parameters as decreased cohesion between particles and improved admix and charge through characteristics.

Figure 10:
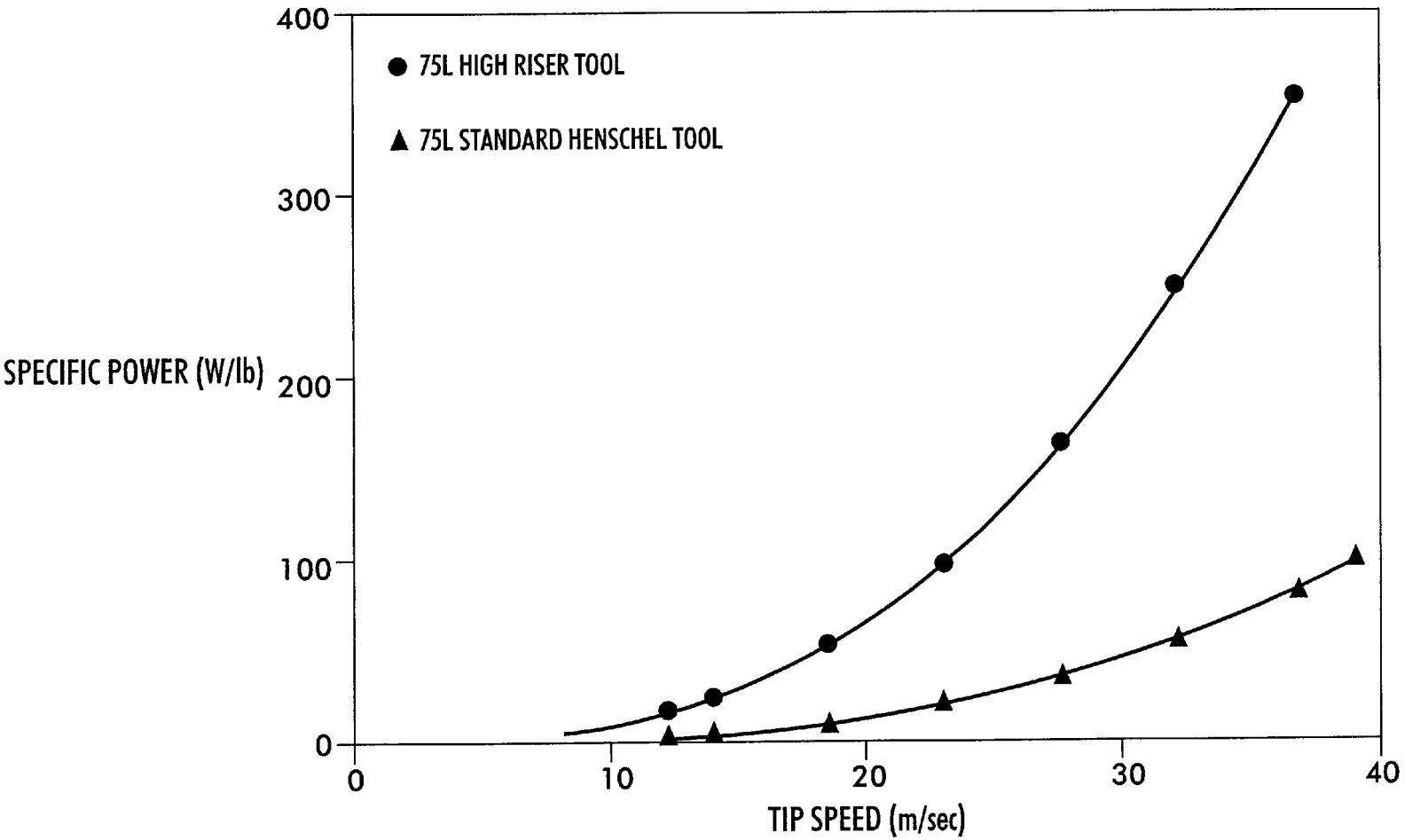
FIG. 10 is a graph showing specific power values varying with tool tip speed for several blending tools mounted within a 75 liter blender.

Turning now to FIG. 10, Specific Power curves are shown for a tool 50 of the present invention and a standard Henschel tool configured as shown in FIG. 2, both sized for a 75 liter vessel. As discussed above, a tool of the Littleford design is not made for this size vessel. When compared to the curves in FIG. 9, it is clear that Specific Power curves decrease in magnitude as the vessel size increases. Since, as shown in FIGS. 8 and 9, the 10 liter Littleford tool barely achieved a Specific Power of 200 Watts/lb. even at tip speeds of 40 meters/second, the curves in FIG. 10 clearly indicate that a 75 liter tool based on the Littleford tool, even if available, would not achieve a Specific Power of 200 Watts/lb. at tip speeds approaching 40 meters/second. In contrast, a 75 liter tool 50 of the present invention achieves a Specific Power measure of 200 Watts/lb. at tip speeds as low as 30 meters/second. As will be discussed below, a Specific Power of 200 Watts/lb. appears to be an important threshold measure for a series of favorable toner characteristics.

Returning to FIG. 5, another feature of tool 50 as shown in FIG. 5 is through hole flow ports 52C and 52D on riser 52 and 53C and 53D on riser 53. For a tool configured for a 75 liter blending vessel, the flow ports may optimally have a diameter between 1.5 and 3 cm and more preferably around 2 cm. As shown, the flow ports are optimally placed toward the rear edges of risers 52 and 53. Also as shown, sculpted depressions in the inward surface of risers 52 and 53 allow particles to flow towards the flow ports, and the increased pressure on the inward face of risers 52 and 53 combined with the relatively lower pressure between the risers and the walls of vessel 10 tends to force particles from the inside of the risers into the maximum blending zone between the risers and the blending vessel walls. The flow ports have the further beneficial effect of flowing particles into the blending zone that otherwise may adhere to the inside faces of the risers, particularly near the juncture of the risers and the central shank 51. Such a build-up of adhered particles causes a residual of unblended or partially blended material that flow ports ameliorate. This reduction in build-up has the further beneficial effect of reducing vibration in the tool since less build-up tends to maintain the balance of the tool which often becomes unbalanced by differential particle build-ups on one riser verses the other. By visual and weight comparisons between similar tools with and without flow ports 52C, 52D, 53C, and 53D, it appears that the flow ports reduce build-up by approximately forty (40) percent in a 75 liter vessel. Thus, the addition of flow ports further improves the intensity and performance of tools of the present invention and renders a more thorough blending of toners and additives in the blending vessel.

Figure 1:
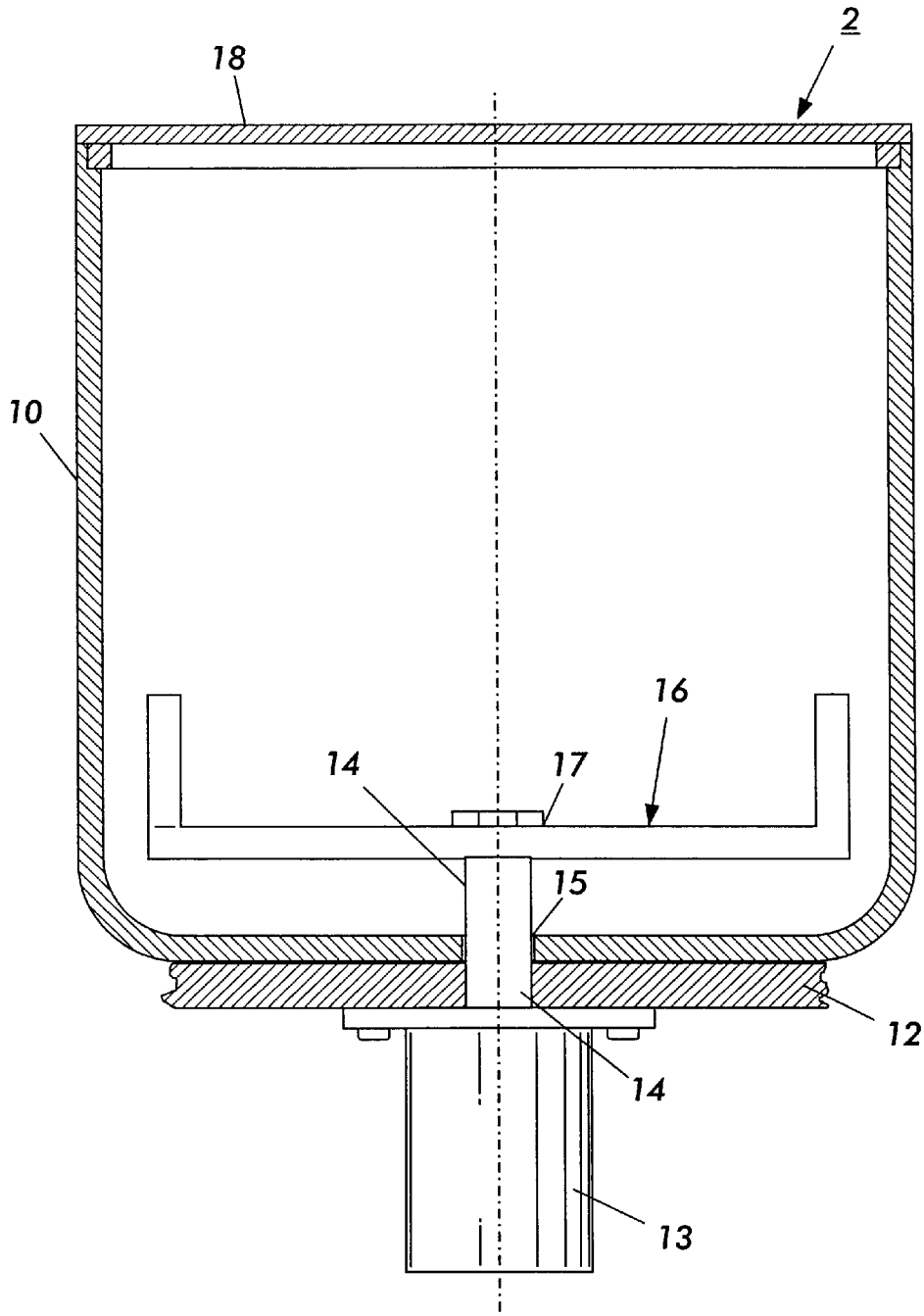
FIG. 1 PRIOR ART
FIG. 1 is a schematic elevational view of a blending machine of the prior art.

Also as shown in FIGS. 4 and 5, an apparent difference between tool 50 of the present invention and the Littleford tool shown as tool 16 in FIG. 3 is that tool 50 of the present invention includes blades 54A and 54B that are generally tapered from their base rather than having club-shaped end regions. These blades 54A and 54B increase the average velocity of particles within the blending vessel by imparting further velocity to the fluidized particles in the blending vessel. In addition, the middle and end portions of blades 54A and 54B have "swept-back" leading edges such that the axis of these blades is angled backwards, away from the direction of rotation. This swept-back feature allows particles to remain in contact with or in proximity to the blades for a longer period of time by rolling outward along the swept-back edges. Also, even without such rolling, the swept-back angle imparts a directional vector to collided particles that sends them outward toward the walls of vessel 10. By increasing the density of particles along the walls of vessel 10, this swept-back feature greatly increases the intensity imparted by risers 52 and 53 since these risers operate in proximity to the vessel walls. Also, in contrast to the Littleford tool, blades 54A and 54B extend to close proximity to the blending vessel wall. This feature further increases the density of particles along the vessel wall, where blending occurs as discussed above. Lastly, in the configuration shown, blades 54A and 54B are attached directly to the sides of shank 51 rather than being on a separate bottom scraper blade as in a standard Henschel blending tool such as shown in FIG. 2. In this manner, blades 54A and 54B do not occupy any vertical space of shaft 14 of the blending machine (shaft 14 is shown in FIG. 1). This saving of vertical space, in turn, enables shank 51 and the bottom portion of risers 52 and 53 to rotate closer to the bottom of vessel 10 where the density of particles naturally increases due to gravity. Of course blades 54A and 54B could be mounted on a separate shank attached above or below shank 51 but such separate tool does not have the benefits of placing all blades as low as possible within vessel 10.

Thus, compared to the prior art, blades 54A and 54B increase the density of particles in proximity to the walls of the blending vessel and, when attached to the sides of shank 51, provide the benefits of a separate bottom scraper tool without the deleterious effect of raising the working tool higher from the bottom of the blending vessel. When coupled with the increased efficiencies of risers 52 and 53, as described above, blades 54A and 54B significantly increase the blending intensity of improved tool 50.

Yet another aspect of the present invention is an improved toner with a greater quantity of surface additives and with greater adhesion of these additive particles to the toner particles. As discussed above, after the process step of classification, the next typical process in toner manufacturing is a high speed blending process wherein surface additive particles are mixed with the classified toner particles within a high speed blender. These additives include but are not limited to stabilizers, waxes, flow agents, other toners and charge control additives. Specific additives suitable for use in toners include fumed silica, silicon derivatives such as Aerosil® R972, available from Degussa, Inc., ferric oxide, hydroxy terminated polyethylenes such as Unilin®, polyolefin waxes, which preferably are low molecular weight materials, including those is with a molecular weight of from about 1,000 to about 20,000, and including polyethylenes and polypropylenes, polymethylmethacrylate, zinc stearate, chromium oxide, aluminum oxide, titanium oxide, stearic acid, and polyvinylidene fluorides such as Kynar. The most preferred $SiO_2$ and $TiO_2$ have been surface treated with compounds including DTMS (dodecyltrimethoxysilane) or HMDS (hexamethyldisilazane). Examples of these additives are: NA50HS silica, obtained from DeGussa/Nippon Aerosil Corporation, coated with a mixture of HMDS and aminopropyltriethoxysilane; DTMS silica, obtained from Cabot Corporation, comprised of a fumed silica, for example silicon dioxide core L90 coated with DTMS; H2050EP, obtained from Wacker Chemie, coated with an amino functionalized organopolysiloxane; and SMT5103, obtained from Tayca Corporation, comprised of a crystalline titanium dioxide core MT500B, coated with DTMS.

Zinc stearate is preferably also used as an external additive for the toners of the invention, the zinc stearate providing lubricating properties. Zinc stearate provides developer conductivity and tribo enhancement, both due to its lubricating nature. In addition, zinc stearate enables higher toner charge and charge stability by increasing the number of contacts between toner and carrier particles. Calcium stearate and magnesium stearate provide similar functions. Most preferred is a commercially available zinc stearate known as Zinc Stearate L, obtained from Ferro Corporation, which has an average particle diameter of about 9 microns, as measured in a Coulter counter.

As discussed above, newer color toner particles are in the range of 4–10 microns, which is smaller than previous monochrome toner particles. Additionally, whereas prior art toners typically have surface additives attached to toner particles at less than 1% weight percent, newer color toners require more robust flow aids, charge control, and other qualities contributed by surface additives. Accordingly, the size of surface additive particles is desired to be increased into the 30 to 50 nanometer range and the amount of surface additives is desired to be in excess of 5% weight percent. The combination of smaller toner particles and larger surface additive particles makes attachment of increased amounts of additives more difficult.

In one example, the toners contain from about 0.1 to 5 weight percent titania, about 0.1 to 8 weight percent silica and about 0.1 to 4 weight percent zinc stearate. For proper attachment and functionality, typical additive particle sizes range from 5 nanometers to 50 nanometers. Some newer toners require a greater number of additive particles than prior toners as well as a greater proportion of additives in the 25–50 nanometer range. The $SiO_2$ and $TiO_2$ may preferably have a primary particle size greater than approximately 30 nanometers, preferably of at least 40 nm, with the primary particles size measured by, for instance transmission electron microscopy (TEM) or calculated (assuming spherical particles) from a measurement of the gas absorption, or BET, surface area. $TiO_2$ is found to be especially helpful in maintaining development and transfer over a broad range of area coverage and job run length. The $SiO_2$ and $TiO_2$ are preferably applied to the toner surface with the total coverage of the toner ranging from, for example, about 140 to 200% theoretical surface area coverage (SAC), where the theoretical SAC (hereafter referred to as SAC) is calculated assuming all toner particles are spherical and have a diameter equal to the volume median diameter of the toner as measured in the standard Coulter counter method, and that the additive particles are distributed as primary particles on the toner surface in a hexagonal closed packed structure. Another metric relating to the amount and size of the additives is the sum of the "SAC×Size" (surface area coverage times the primary particle size of the additive in nanometers) for each of the silica and titania particles or the like, for which all of the additives should preferably have a total SAC×Size range of between, for example, 4500 to 7200. The ratio of the silica to titania particles is generally between 50% silica/50% titania and 85% silica/15% titania, (on a weight percentage basis), although the ratio may be larger or smaller than these values, provided that the objectives of the invention are achieved. Toners with lesser SAC×Size could potentially provide adequate initial development and transfer in HSD systems, but may not display stable development and transfer during extended runs of low area coverage (low toner throughput).

In order to measure the adhesive force of surface additives to toner particles, a measurement technique is required. Such a technique is disclosed in patent applications titled "Method for Additive Adhesion Force Particle Analysis and Apparatus Thereof", U.S. Ser. No. 09/680,048, filed on Oct. 5, 2000, and "Method for Additive Adhesion Force Particle Analysis and Apparatus Thereof", U.S. Ser. No. 09/680,066, filed on Oct. 5, 2000, The technique taught in such applications yields a value known as an "Additive Adhesion Force Distribution" ("AAFD") value. Both applications are hereby incorporated by reference. In effect, AAFD value is a measure of how well a surface additive sticks to a toner particle even after being blasted with intense sonic energy. As specifically applied to the improved toners herein, the AAFD measurement technique comprises the following:

Stage 1—Stirring

1. Weigh approx. 2.6 g toner into 100 ml Beaker
2. Add 40 ml 0.4% Triton-X solution
3. Stir for 5 min. in 4 station automated stirrer (Start at ~20K rpm, slowly increase to 30K-40K-50K rpm)
4. Check for non-wetted particles, re-stir if necessary.

Stage 2—Sonification (4 horn setup)

1. Sonify at 0 kJ (that is, no sonification), 3 kJ and 6 kJ in sonifier model Sonica Vibra Cell Model VCX 750 made by Sonics and Materials, Inc. using four (4) ⅝ inch horns at frequency of 19.95 kHz.
2. Horns are matched and calibrated for each energy level. For 0 kJ, the time is 0 minutes; for 3 kJ, time is 2.5 to 3.0 minutes; and for 6 kJ, time is 5.0–6.0 minutes.
3. Horn should be 2 mm from beaker bottom.
4. Transfer to labeled disposable 50 ml Centrifuge Tube (Pour ½ in, swirl, pour remainder in, add distilled water to bring solution to 45 ml.)
5. Centrifuge immediately Stage 3—Centrifuging 1. Centrifuge at 2000 rpm for 3 min.
2. Decant supernatant liquid, add 40 ml distilled water, shake well. (add 10 ml Triton-X solution if necessary)
3. Centrifuge at 2000 rpm for 3 min.
4. Decant supernatant liquid, add 40 ml Dl, shake well
5. Centrifuge at 2000 rpm for 3 min.
6. Decant supernatant liquid, add very small amount of distilled water. Re-disperse w/spatula.

Stage 4—Filtering

1. Turn on filtration machine with wet Whatman #5 Filter
2. Rinse spatula with distilled water onto filter center; pour rinse slowly into center of filter; rinse 1 or 2 times with squirt of distilled water; pour rinse onto filter slowly, rinse with 10 ml distilled water; pour rinse onto filter
3. Turn off filter machine
4. Remove filter and dry overnight on top of oven in hood.

Stage 5—Grinding/Pellet Press

1. Transfer Toner to weighing paper by turning filter over and tapping filter with spatula without scraping filter.
2. Curl weighing paper and pour sample into plastic grinder container.
3. Grind for 4–5 min.
4. Press into pellets Stage 6—Compute AAFD value Analyze by Wavelength Dispersive X-Ray Fluorescence Spectroscopy (WDXRF) to compare percent of remaining surface additives (particularly SiO2 and TiO2) to percent of additives in non-sonified control pellets. The ratio equals the AAFD value expressed as a percent. WDXRF works because each additive such as SiO2 can be detected by its characteristic frequency.

A series of Pareto analyses confirms that when AAFD values are computed for variations of blend intensity, speed of tool, and amount of additives, the factor that most influences AAFD values is blend intensity. The second ranking factor is minimization of the amount of additives present. However, as discussed above, a goal of the improved toner of the present invention is both an increase in adhesion and an increase in the total quantity of additives. As such, an improved blending tool offering increased blend intensity is a prime factor in achieving the improved toner of the present invention.

Figure 11:
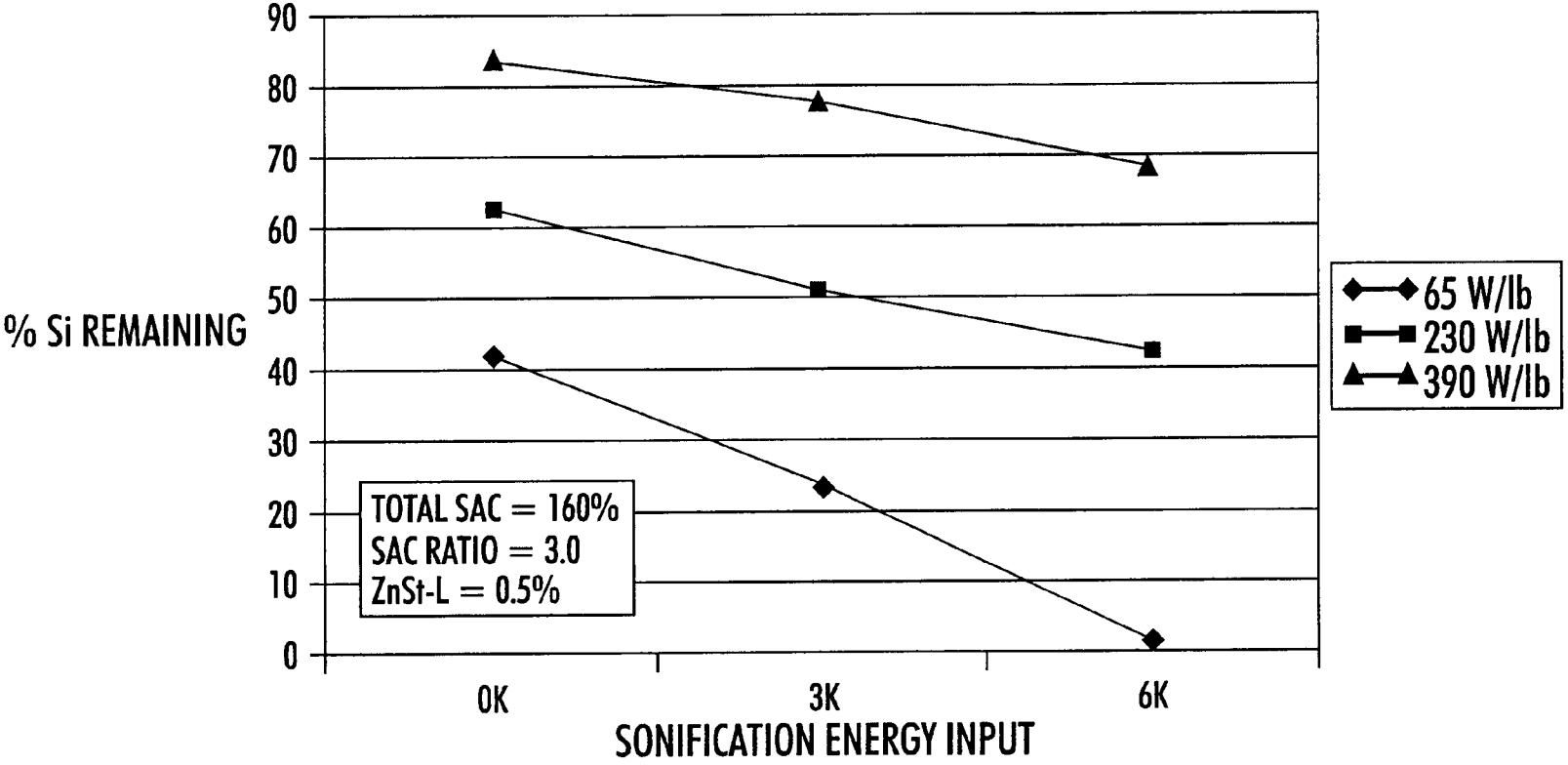
FIG. 11 is a graph showing AAFD values for various blending intensities after various levels of sonification.

Turning now to FIG. 11, the improvement of AAFD values caused by increased Specific Power during blending is demonstrated by 3 curves providing AAFD values for 3 levels of Specific Power. The y-axis of the chart in FIG. 11 indicates the percent of $SiO_2$ surface additives remaining after the AAFD procedures above. The x-axis shows three levels of sonification, including no sonification and sonification at 3 kJoules and 6 kJoules. Each curve was generated using identical toners having Surface Area Coverage of 160% which is equivalent to 6.7% weight percent total additive of $SiO_2$ and $TiO_2$ in a Surface Area Coverage Ratio of $SiO_2$ to $TiO_2$ of 3.0, and a weight percent of Zinc Stearate equal to 0.5%. The only difference is the amount of Specific Power which, in turn, is the direct result of different tools used during the blending process.

The lowest curve with the worst AAFD measures was made using the standard Henschel blending tool of the design shown in FIG. 2. After 6 kJoules of sonfication energy applied to toners made with this tool, nearly all $SiO_2$ surface additives were removed, indicating a low degree of surface additive attachment. The middle curve was generated for toners made with Specific Power of 230 Watts/lb. This Specific Power can be generated with the Littleford tool only in a non-commercial 10 liter configuration and only at extremely high tool speeds, as shown in FIG. 9. As described above in relation to FIG. 10, the Littleford tool is not made for a 75 liter vessel, and if it were made for a 75 liter vessel, it would generate far less than 230 Watts/lb Specific Power. For a toner made with Specific Power of 230 Watts/lb., the curve in FIG. 11 indicates that after blending and before sonification, over 60% of $SiO_2$ surface additives remain attached to toner particles. Even after 6 kJoules of sonification energy, over 40% of surface additives remain attached. Experience indicates that for most purposes, these AAFD values indicate an acceptable level of surface additives that will yield adequate admix and charge through, cohesion, and minimized wire contamination effects.

Adequate admix and charge through is defined as a state in which freshly added toner rapidly gains charge to the same level of the incumbent toner (toner that is present in the developer prior to the addition of fresh toner) in the developer. When freshly added toner fails to rapidly charge to the level of the toner already in the developer, a situation known as slow admix occurs, and two distinct charge levels exist side-by-side in the development subsystem. In extreme cases, freshly added toner that has no net charge may be available for development onto the photoreceptor. Conversely, when freshly added toner charges to a level higher than that of toner already in the developer, a phenomenon known as charge through occurs, in which the low charge or opposite polarity toner is the incumbent toner.

Wire contamination effects occur when a surface of the wire that is in contact with the HSD development system donor roll becomes coated with a layer of toner or toner constituents. Wire contamination is a particular problem when the layer of toner constituents comprises toner particles that are highly enriched in external toner additives that may become dislodged from the toner particles themselves.

Returning to FIG. 11, the highest curve was generated with the tool of the present invention generating Specific Power of 390 Watts/lb. As shown in FIGS. 9 and 10, tools of the present invention are the only tools known to be capable of generating such Specific Power. With this Specific Power of 390 watts/lb., over 80% of surface additives are attached after blending and nearly 70% remain attached even after being subjected to 6 kJoules of sonification energy. Thus, the AAFD values of FIG. 11 demonstrate both the improved surface value adhesion of toners made with a novel blending tool of the present invention and the fact that toners made with higher Specific Power levels both start with higher levels of surface additives and maintain higher levels of attachment to these additive particles even after being subjected to forces that tend to separate toner particles from additive particles.

Figure 12:
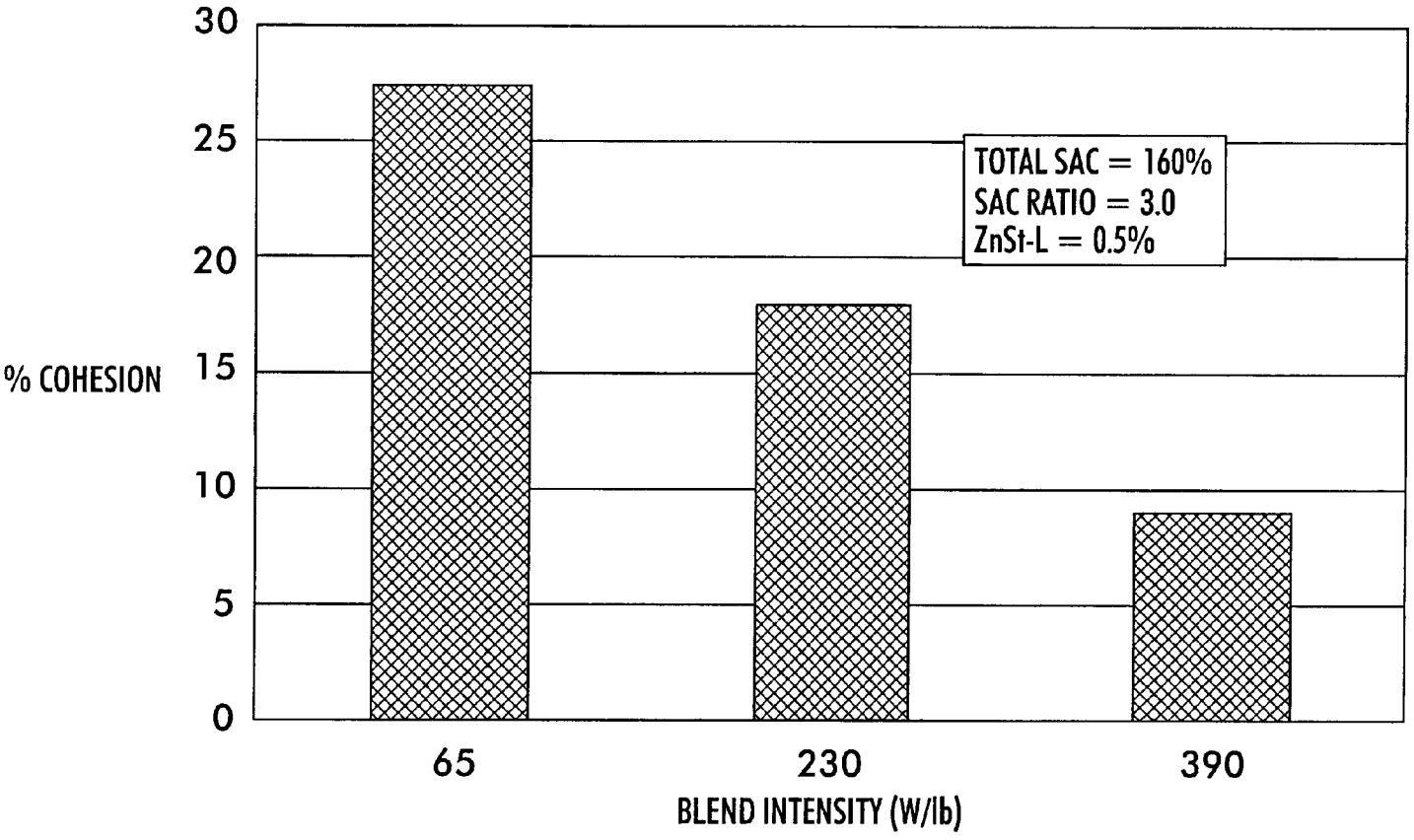
FIG. 12 is a bar graph comparing the amount of cohesion between particles after 3 different levels of blend intensity.

Turning now to FIG. 12, improvements in the cohesion and toner flow characteristics of toners is demonstrated for toners made using blending tools of the present invention. It is well known that toner cohesivity can have detrimental effects on toner handling and dispensing. Toners with being added to the developer mixing system. Conversely, toners with very low cohesion can result in difficulty in controlling toner dispense rates and toner concentration, thereby causing excessive dirt in the printing apparatus. In addition, in a HSD system, toner particles are first developed from a magnetic brush to two donor rolls. Toner flow must be such that the HSD wires and electric development fields are sufficient to overcome the toner adhesion to the donor roll and to enable adequate image development to the photoreceptor. Following development to the photoreceptor, the toner particles must be transferable from the photoreceptor to the substrate. For the above reasons, it is desirable to tailor toner flow properties to minimize both cohesion of particles to one another and adhesion of particles to surfaces such as the donor rolls and the photoreceptor. Such favorable flow characteristics provide reliable image performance due to high and stable development and high and uniform transfer rates.

Toner flow properties are most conveniently quantified by measurement of toner cohesion. One standardized procedure follows the following protocol and may be performed using a Hosokawa Powders Tester, available from Micron Powders Systems:

1) place a known mass of toner, for example two grams, on top of a set of three screens with screen meshes of 53 microns, 45 microns, and 38 microns in order from top to bottom;
2) vibrate the screens and toner for a fixed time at a fixed vibration amplitude, for example for 90 seconds at a 1 millimeter vibration amplitude;
3) Measure the amount of toner remaining on each of the screens at the end of the vibration period.

A cohesion value of 100% means that all of the toner remained on the top screen at the end of the vibration step. A cohesion value of zero means that all of the toner passed through all three screens, i.e., no toner remained on any of the three screens at the end of the vibration step. The higher the cohesion value, the less the flowability of the toner. Minimizing the toner cohesion will provide higher levels and more stable development and higher levels and more uniform toner transfer.

FIG. 12 charts the results of the above procedures for 3 identical toners made with three different levels of Specific Power. The toners are the same formulations as used to generate FIG. 11, and the Specific Power values of the tools are also the same. In brief, the 65 Watts/lb. Specific Power corresponds to the standard Henschel blending tool. The 230 Watts/lb. Specific Power is easily achievable with tools of the present invention but achievable using the standard Littleford prior art tool only in non-commercial sized 10-liter vessels. The 390 Watts/lb. Specific Power is only achievable with tools of the present invention. As shown in FIG. 12, the percent of cohesion correlates inversely with the Specific Power used during blending. The best, or lowest, cohesion performance was obtained at the highest Specific Power level of 390 Watts/lb. Thus, as expected, higher Specific Power results in the adherence of more surface additives with more average attachment per particle. This, in turn, induces decreased cohesion between toner particles and optimized flowability of the toner mixture.

In summary, this description of the present invention has described an improved blending tool, an improved method of making toners, and improved toners with greater quantities of surface additives attached to toner particles with stronger attachments. The improved blending tool of the present invention includes raised risers at the end of a central shank, such risers being angled relative to the plane perpendicular to the axis of the shank at an angle less than 17 degrees. The improved tool may also have "swept-back" scraper blades mounted at the mid-section of the central shank. When compared to known blending tools in the prior art, a tool of the present invention permits higher blend intensity than heretofore possible. Higher blend intensity enables substantial cost savings by decreasing the time required for toner blending, thereby increasing productivity. Moreover, the high intensity blending of the present invention yields an improved toner composition having greater quantities of surface additives than heretofore known attached with greater adhesion between surface additives and toner particles, thereby improving toner characteristics such as flowability.

It is, therefore, evident that there has been provided in accordance with the present invention a blending tool and toner particles that fully satisfies the aims and advantages set forth above. While the invention has been described in conjunction with several embodiments, it is evident that many alternatives, modifications, and variations will be apparent to those skilled in the art. Accordingly, it is intended to embrace all such alternatives, modifications, and variations as fall within the spirit and broad scope of the appended claims.

What is claimed is:

1. An improved toner, comprising:

(a) at least one colorant;

(b) at least one toner resin mixed with the colorant and wherein said colorant and toner resin composite is of an average volume diameter size of equal to or less than about 15 microns; and (c) surface additive particles wherein the surface additives adhere to the colorant and toner resin by impaction in a quantity of equal to or greater than about three (3) percent of the combined weight of toner resin and colorant in the toner wherein the toner has a Additive Adhesion Force Distribution percent value and wherein the Additive Adhesion Force Distribution percent value after 6 kiloJoules of sonification energy is greater than or equal to 25 percent.

2. The improved toner of claim 1, wherein the quantity of surface additives is greater than about four (4) percent of the combined weight of resin and colorant in the toner.

3. The improved toner of claim 1, wherein the quantity of surface additives is greater than about five (5) percent of the combined weight of resin and colorant in the toner.

4. The improved toner of claim 1, wherein the quantity of surface additives is greater than about six (6) percent of the combined weight of resin and colorant in the toner.

5. The improved toner of Claim 1, wherein the average size of colorant and resin particle composite is from about 4 to about 10 microns.

6. The improved toner of claim 1, wherein the toner has a Additive Adhesion Force Distribution percent value and wherein the Additive Adhesion force Distribution percent value after 6 kiloJoules of sonification energy is greater than or equal to 40 percent.

7. The improved toner of claim 6, wherein the Additive Adhesion Force Distribution percent values were obtained using four (4) ⅝ inch horns emitting at a frequency of 19.95 kiloHertz from a distance of approximately 2 millimeters.

8. The improved toner of claim 6, wherein the Additive Adhesion Force Distribution percent value is measured on toners blended for less than about 10 minutes.

9. The improved toner of claim 1, wherein the toner is blended for less than about 10 minutes.

10. The improved toner of claim 1, wherein the toner composition has a Additive Adhesion Force Distribution percent value and wherein the Additive Adhesion Force Distribution percent value after 3 kiloJoules of sonification energy is greater than about 35 percent.

11. The improved toner of claim 10, wherein the Additive Adhesion Force Distribution percent value after 3 kiloJoules of sonification energy is greater than about 50 percent.

12. The improved toner of claim 1, wherein the toner composition has a percent of cohesion between particles of colorant and resin and wherein the percent cohesion between particles of colorant and resin is less than or equal to about 25 percent.

13. The improved toner of claim 1, wherein the toner composition has a percent of cohesion between particles of colorant and resin and wherein the percent cohesion between particles of colorant and resin is less than or equal to about 20 percent.

14. The improved toner of claim 1, wherein the surface additive particles are selected from the group consisting essentially of fumed silica, silicon derivatives, ferric oxide, hydroxy terminated polyethylenes, polyolefin waxes, including polyethylenes and polypropylenes, polymethylmethacrylate, zinc stearate, chromium oxide, aluminum oxide, titanium oxide, stearic acid, and polyvinylidene fluorides.

* * * * *